US005584975A

United States Patent [19]

Pohto et al.

[11] Patent Number: 5,584,975

[45] Date of Patent: Dec. 17, 1996

[54] TUBULAR ELECTRODE WITH REMOVABLE CONDUCTIVE CORE

[75] Inventors: Gerald R. Pohto, Mentor; Andy W. Getsy, Eastlake, both of Ohio

[73] Assignee: Eltech Systems Corporation, Chardon, Ohio

[21] Appl. No.: 491,192

[22] Filed: Jun. 15, 1995

[51] Int. Cl.[6] ..... C25B 11/00

[52] U.S. Cl. ..... 204/288; 204/280; 204/286; 204/290 F; 204/290 R; 204/292; 29/825; 29/868

[58] Field of Search ..... 204/288, 286, 204/280, 290 F, 290 R, 292; 29/825, 868

[56] References Cited

U.S. PATENT DOCUMENTS

| | | | |
|---|---|---|---|
| H1314 | 6/1994 | Shipes | 29/825 |
| 3,265,526 | 8/1966 | Beer | 117/50 |
| 3,632,498 | 1/1972 | Beer | 204/290 F |
| 3,676,325 | 7/1972 | Smith et al. | 204/288 |
| 3,711,385 | 1/1973 | Beer | 204/59 |
| 3,857,774 | 12/1974 | Morton et al. | 204/242 |
| 3,907,659 | 9/1975 | Paige et al. | 204/290 F |
| 3,919,068 | 11/1975 | Gary | 204/286 |
| 4,014,763 | 3/1977 | Lowe | 204/106 |
| 4,033,849 | 7/1977 | Pohto et al. | 204/286 |
| 4,096,057 | 6/1978 | Annis, Jr. et al. | 204/280 |
| 4,120,773 | 10/1978 | Ridgway | 204/288 |
| 4,129,292 | 12/1978 | Pohto et al. | 269/126 |
| 4,154,667 | 5/1979 | Pohto et al. | 204/286 |
| 4,171,254 | 10/1979 | Koenecke | 204/197 |
| 4,255,012 | 3/1981 | Parent et al. | 339/242 |
| 4,268,371 | 5/1981 | Brun et al. | 204/280 |
| 4,338,179 | 7/1982 | Dickson et al. | 204/284 |
| 4,456,517 | 6/1984 | Rolf et al. | 204/286 |
| 4,460,450 | 7/1984 | Koziol et al. | 204/290 F |
| 4,515,673 | 5/1985 | Hayfield | 204/290 F |
| 4,528,084 | 7/1985 | Beer et al. | 204/290 F |
| 4,647,358 | 3/1987 | Bartsch et al. | 204/286 |
| 4,657,652 | 4/1987 | Hodges | 204/269 |
| 4,824,543 | 4/1989 | Peterson et al. | 204/280 |
| 4,871,436 | 10/1989 | den Hartog | 204/286 |
| 4,882,027 | 11/1989 | Borst et al. | 204/286 |
| 5,094,735 | 3/1992 | Lang, Jr. | 204/286 |
| 5,277,776 | 1/1994 | Borner et al. | 204/279 |
| 5,431,797 | 7/1995 | Harvey | 204/292 |

*Primary Examiner*—Bruce F. Bell
*Attorney, Agent, or Firm*—John J. Freer; David J. Skraber

[57] ABSTRACT

An electrode assembly which will find use such as in electroplating, is made from a hollow and thin walled, elongate and deflectable outer metal electrode member. This member is usually rounded, e.g., typically circular, in cross-section and has major inner and outer faces. Representative of this outer member would be a titanium tube. The electrode assembly also has a removable and elongate, inner metal electrical current distributor member. This inner current distributor member will typically be rectangular in cross-section. Representative of this inner member is a rectangular copper bar. As assembled, this typical assembly can have the edges on the outer face of the copper bar engage the inner face of the titanium tube. In putting together this particular assembly, the hollow tube is compressed, such as from circular to elliptical shape. The copper bar current distributor is inserted into this misshapen tube. When the pressure on the electrode member tube is released, the resulting spring reaction of the tube flexes it back onto the corners of the copper bar. These corners bite into the interior face of the titanium tube. This procedure is reversible when the electrode assembly is in need of refurbishing.

78 Claims, 3 Drawing Sheets

TUBULAR ELECTRODE WITH REMOVABLE CONDUCTIVE CORE

BACKGROUND OF THE INVENTION

1. Field of the Invention

The present invention relates to an electrode assembly which can be used in a cell such as for electroplating. The electrode assembly has an outer metal electrode member which typically is tube-like. The electrode assembly also has an inner metal electrical current distributor member. In cross-section, the current distributor member has edges which bite into the inner face of the hollow electrode member providing electrical junction between the members.

2. Description of the Related Art

It has been known to construct electrodes which are composites of an outer sheath of one metal and an inner core of a differing metal. For example, in U.S. Pat. No. 4,657,652 there is disclosed an electrode having a metal sheath such as of titanium over a supporting core, which can be of copper or aluminum. The titanium sheath is provided to cover the core metal and provide the working surface of the electrode. There can be a strong metallurgical bonding between the metals.

It has also been known to construct electrodes of spaced-apart plates with a core filler. In U.S. Pat. No. 4,460,450 there are disclosed electrodes of electrode plates sandwiching an area between the electrode plates. The area can include wires combined with the use of the core metal filler. The wires are welded to the electrode plates. The patent teaches that zinc can serve as a core metal filler.

It has also been known to form opposing sheets of titanium into an envelope and use a particulate filler. Such a composite electrode has been shown in U.S. Pat. No. 3,907,659. Therein it is taught to utilize two opposing sheets of titanium to form an envelope. Copper wool or shredded copper, in a compressed state, is disposed within the envelope to provide a core of substantially enhanced electrical conductivity, while the titanium sheets protect the copper from chemical corrosion.

It has also been known to prepare a protected electrode structure using a sheath and core structure, where the core is an electrode. Such a structure has been taught in U.S. Pat. No. 4,171,254. The teachings of this patent are directed to a structure where a sacrificial anode is placed in an environment where metal-to-metal impacts are possible and could create dangerous sparking. To prevent against this, the patent teaches shielding the sacrificial anode with an outer perforate shield. The perforate shield will permit ongoing sacrificial action of the inner anode while supplying a protective casing for eliminating contact of the anode with other metal structure.

It would still be desirable to provide an electrode assembly having a core structure which is protected by an outer electrode, not only during use of the electrode, but also during refurbishing of the electrode. Such assembly would, however, need to maintain highly efficient and economical electrical contact between the electrode outer component and the inner core of substantially greater electrical conductivity.

SUMMARY OF THE INVENTION

There is now provided an electrode assembly which achieves a very uniform current density, top to bottom of the assembly, in use. This assembly utilizes a highly efficient and economical electrical contact between an outer electrode component, and an inner current distributor. It offers ease of assembly. Moreover, in assembly, the inner conductive core is removable. Thus, the outer electrode not only protects the conductive core during electrochemical operation but the core can also be protected, as by easy removal, before refurbishing of the electrode.

In one aspect, the invention is directed to an electrode assembly comprising a hollow and substantially thin walled, elongate and deflectable, outer metal electrode member having inner and outer major faces and an at least substantially rounded cross section, such assembly having a removable and elongate, inner metal electrical current distributor member which has an outer major face, with the perimeter of the electrode member inner face being in flexed engagement with less than all of the perimeter of the current distributor member outer face by autogenous compressive force of the electrode member, and with such engagement providing electrical junction between the current distributor member and the electrode member.

In another aspect, the invention is directed to the method of making an electrode assembly having the aforesaid outer metal electrode member, as well as having the aforementioned inner metal electrical current distributor member, which method comprises:

(a) compressively flexing the hollow and deflectable electrode member of substantially rounded cross-section into deflected shape, such deflection being maintained below the yield point of the metal of the electrode member;

(b) inserting the current distributor member within the deflected shape of the hollow electrode member; and (c) releasing the flexed compression on the electrode member, establishing flexed engagement between less than all of the perimeter of the current distributor member outer face and the perimeter of the inner face of the electrode member by autogenous compressive force of the electrode member, with such flexed engagement providing electrical junction between the current distributor member and the electrode member.

In a still further aspect, the invention is directed to a method of refurbishing the electrode assembly where, to initiate refurbishing, the hereinabove described step (a) is undertaken. The current distributor member is then removed from the electrode member. The electrode member is next refurbished, such as by removal of any coating from the outer face of the electrode member and application of fresh coating thereto. Then, the freshly coated electrode member is processed in accordance with the hereinabove described steps (a), (b) and (c).

In a still further aspect, the invention is directed to an electrode assembly comprising:

(1) a hollow and substantially thin walled, elongate and deflectable, outer metal electrode member having inner and outer major faces and an at least substantially rounded cross section;

(2) a removable and elongate, inner metal electrical current distributor member which has an outer major face; and (3) a metal spring member positioned between, and in flexed engagement with, both of the electrode member inner face and the current distributor member outer face, whereby the flexed engagement provides electrical junction and maintains positioning between the current distributor member and the electrode member.

In another aspect, the invention pertains to the method of making an electrode assembly by:

(a) providing a hollow and deflectable electrode member of substantially rounded cross-section;

(b) providing as a current distributor member at least two tapered wedge members;

(c) inserting the current distributor member tapered wedge members within the hollow electrode member by wedging together such members in a manner engaging the inner face of the electrode member and flexing such electrode member into flexed engagement; thereby (d) establishing flexed engagement between the current distributor member outer major face and the inner face of the electrode member, with the edge engagement providing electrical junction between the current distributor member and the electrode member.

In a most representative assembly, there is used a titanium tube of circular cross-section which has an electrochemically active coating on its outer surface. The tube is pressed into an elliptical shape and, in this most representative aspect of the invention, a copper bar which is rectangular in cross section is inserted into the tube to serve as electrical distributor. The pressure on the tube is released and in the resulting spring reaction of the tube, the corners of the copper bar bite into the face of the titanium tube and make electrical contact which can be a continuing contact over the length of the tube. The procedure is easily reversible for disassembly when the assembly is in need of refurbishing or repair.

DESCRIPTION OF THE PREFERRED EMBODIMENTS

Figure 1:
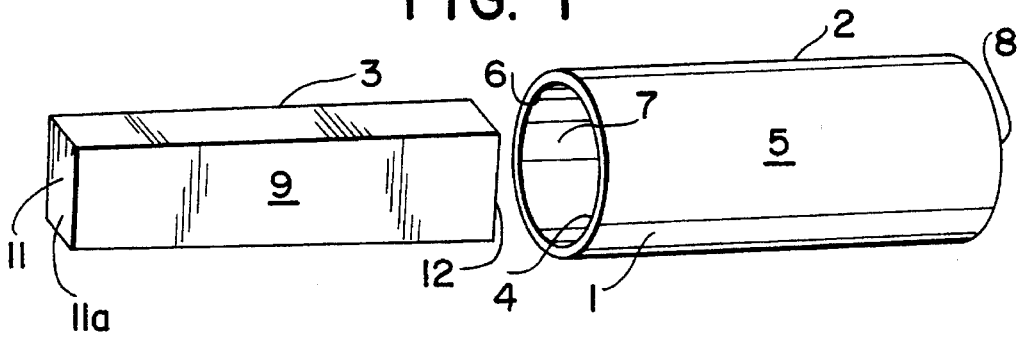
FIG. 1 is a perspective view of two major elements, unassembled, of an electrode assembly showing the outer electrode member and inner current distributor member.

The metals of the electrode member, particularly when the member will serve as an anode, will most always be valve metals, including titanium, tantalum, aluminum, zirconium and niobium, although the use of other metals is contemplated, e.g., nickel and steel where the electrode member is a cathode. Of particular interest for its ruggedness, corrosion resistance and availability is titanium. As well as the normally available elemental metals themselves, the suitable metals of the electrode member can include metal alloys and intermetallic mixtures, such as contain one or more valve metals, For example, titanium may be alloyed with nickel, cobalt, iron, manganese or copper. More specifically, grade 5 titanium may include up to 6.75 weight percent aluminum and 4.5 weight percent vanadium, grade 6 up to 6 percent aluminum and 3 percent tin, grade 7 up to 0.25 weight percent palladium, grade 10, from 10 to 13 weight percent molybdenum plus 4.5 to 7.6 weight percent zirconium and so on.

By use of elemental metals, it is most particularly meant the metals in their normally available condition, i.e., having minor amounts of impurities. Thus, for the metal of particular interest, i.e, titanium, various grades of the metal are available including those in which other constituents may be alloys or alloys plus impurities. Grades of titanium have been more specifically set forth in the standard specifications for titanium detailed in ASTM B 265-79. Preferably for economy plus efficiency of operation, the electrode member is grade 1 titanium.

Although use of specialty pipe and tubing is contemplated, the most representative metal titanium is readily available in tubular form for use as the electrode member, with suitable tubes having typical outside diameters of from about 0.5 inch to about 3 inches. These are the materials most readily contemplated for use as the outer metal electrode member. For convenience, such outer metal electrode member may sometimes be referred to herein simply as the "tube" or "tubing" such reference being meant to include light wall pipe. Thus, it will be appreciated that the electrode member is hollow.

As will be appreciated, this tubing is virtually always available in circular cross-section, but other cross-sections such as oval titanium tubing is also contemplated for use. Tubing that is oval in cross-section could be utilized by compressing into circular shape, then relaxing back to oval shape. The readily available titanium tubing can be susceptible to compressive flexing. That is, there is available titanium tubing of these various diameters that has a wall thickness which will provide the tubing with sufficient flexibility to be utilized in the present invention. Generally, commercially available titanium tubing of this flexibility will have a wall thickness within the range from about 0.02 inch to about 0.12 inch By being "thin walled" as the term is used herein, it is meant that the electrode member will have a wall thickness providing flexibility for service in the present invention. Thus, the wall thickness will not preclude the electrode member from being efficiently flexed out of its normal shape, e.g., the shape in which the tube is produced. Also, after release of externally applied pressure, the tube will readily and autogenously spring back toward such normal shape. Generally, a tube is selected to have an outside diameter and wall thickness that can be flexed into a shape that allows the insertion of a conductor bar without yielding the tube material. Also, when the external force deflecting the tube is released, there should desirably be sufficient deflection still remaining in the tube to generate force, i.e., the autogenous compressive force of the tube on release of the externally applied compression, for maintaining electrical contact between the conductor bar and the tube. Typically, to be deflectable, the ratio of outside diameter to wall thickness has a range of approximately 25:1 to about 45:1.

A particularly representative tubing for the electrode member is a tube having an outside diameter (O.D.) of 1.75 inches and a wall thickness of 0.049 inch. The proportion for this thin walled titanium tube of O.D. to wall thickness of 1.75:0.049 is thus about 35:1. This is particularly illustrative of the electrode member being thin walled. This particularly representative tubing, as well as the other commercially available tubing within the outside diameter range mentioned hereinbefore, is generally available as tubing with a circular cross-section. This tubing can be deflected, e.g., under hydraulic or mechanical pressure, from circular to oval shape. It is necessary that the deflection be held below the yield point of the titanium. For the particularly representative titanium tubing of 1.75 inches O.D. and 0.049 inch wall thickness, this bending stress will not exceed about 25,000 pounds per square inch (psi). This will permit the titanium tube to spring back to its original shape. Thus, a circular shaped titanium tube deflected to oval shape under a pressure held below the titanium yield point, will readily spring back toward its circular shape. An oval shaped titanium tube deflected to circular shape, will deflect back toward its original oval shape. To maintain some spring in a circular shaped tube deflected to oval shape, a slight oval shape after spring back is desirable. Generally, for this reason, regardless of shape, the tube will not be permitted by the cross-section of the conductor bar to completely return to its original shape.

It will be understood, particularly by reference to the accompanying drawings, that on deflecting back toward its original shape, the inner perimeter of the electrode member will not completely contact the full outer perimeter of the current distributor member. That is, the current distributor member is not sized to completely fill the hollow area of the deflected electrode member, but rather leave some room therebetween. By this arrangement, an external force can be reapplied to the current distributor member to release the flexed engagement between the members. This permits ready separation of the current distributor member from the electrode member, which is important during assembly refurbishing. Such procedure, including refurbishing, will be more particularly discussed further on hereinbelow.

The length of the electrode member will be essentially dictated by the use of the electrode. Where the electrode assembly will be utilized in electroplating or electrowinning, electrode members ranging in length from about 12 inches to about _100 inches will be most serviceable. For the abovementioned particularly representative titanium tube, a tube length of from about 24 inches to about 60 inches can be particularly useful as the electrode member in an electrode assembly for electroplating. As mentioned hereinabove, such representative tubing can typically have an outside diameter up to about 3 inches. Thus, the electrode member will be elongate. That is, even such shorter representative tubing of 24 inch length and a wide 3 inch diameter will be eight times longer than its width. The electrode member will also be at least substantially straight. By that, it is meant that it might sustain some slight bending, but generally only of a few degrees. Preferably, the electrode member will be a straight member.

Metals for the inner current distributor member are steel, aluminum, silver or copper or may be an intermetallic mixture or alloy thereof, particularly an alloy of aluminum. However, copper provides the best electrical conductivity per unit cost and is the presently preferred material. Although the current distributor member need not always be solid, preferably, for economy and efficient electrical conductivity, the inner metal electrical current distributor member is a solid member in bar form of electrical grade quality copper. The density of copper, and its use as a solid bar, can be particularly desirable where the electrode assembly may be used in turbulent conditions. For convenience, such inner metal current distributor member may sometimes be referred to herein simply as the "bar" or the "copper bar". It is usually a one-piece, i.e., unitary bar. But a particularly useful two-piece bar, as will be more particularly discussed further on hereinbelow, can be provided by two tapered wedge members that can be wedged together to form a current distributor bar.

The representative copper current distributor member is preferably, for economy, simply a copper bar. This is usually a bar that is rectangular in cross-section, although other cross-sectional structures are contemplated, e.g., square, triangular, trapezoid or polygon shape of a few sides, e.g., less than seven sides. It is contemplated that the bar may even be fully rounded in cross-section, as where an oval tube is used with a current distributor of circular cross-section. Moreover, it should be understood that the configuration of the current distributor member can be in other shape. For example, it may be the shape of a trefoil or a quatrefoil or the like. The current distributor member is advantageously selected to be slightly oversized for the opening of the electrode member. This will be an oversizing in the longest dimension of the current distributor cross-section of usually at least about 0.02 inch. For example, with the particularly representative titanium tube mentioned hereinbefore having a 1.75 inches outside diameter and 0.049 inch wall providing a 1.652 inches inside diameter (I.D.), the representative copper bar selected as a current distributor member for such tube can have a rectangular cross-section with dimensions of 1.67 inches height by 0.500 inch width. This provides a diagonal dimension for the copper bar of 1.743 inches which is thus an oversizing of 0.091 inch greater, for the current distributor member longest dimension for its cross-section, than for the opening of the electrode member, i.e., the inner diameter of the titanium tube. Typically, the current distributor member as a four sided figure in cross-section for use in the readily available titanium tubing will have a width within the range from about 0.5 inch to about 4 inches and a thickness within the range from about 0.125 inch to about one inch. Also, although usually discussed as a solid copper bar, it need not be solid. For example, it may be a rectangular copper bar with a central aperture along the length of the bar. This aperture could serve to provide a means for attaching a supporting element, or could be utilized as a conduit for circulating a coolant liquid. Furthermore, the current distributor member may be coated, and such coated current distributor members will be more particularly discussed further on hereinbelow.

Although the current distributor member can be shorter than the electrode member, thus having a length of as short as 10 inches or less, usually it will have a length which extends beyond the length of the electrode member, e.g., a length up to 100 inches or more. This can provide for ease in engaging an electrical connection with the current distributor member. It may also provide for ease in mounting the electrode assembly in a cell arrangement, as for electroplating or electrowinning. Usually, the current distributor member will have a length of from about 2 inches to about 8 inches greater than the length of the electrode member. For the hereinbefore discussed representative electrode assembly, where the titanium tubing is from about 24 inches to about 60 inches in length, a representative solid copper bar will be selected to have a length of from about 26 to about 68 inches in length. Thus, as discussed hereinabove in connection with the electrode member, the current distributor member is also an elongate member. In addition, as for the electrode member, the current distributor member is preferably a straight member but may incur some slight bending, such as to conform to any such bending for an electrode member.

Figure 2:
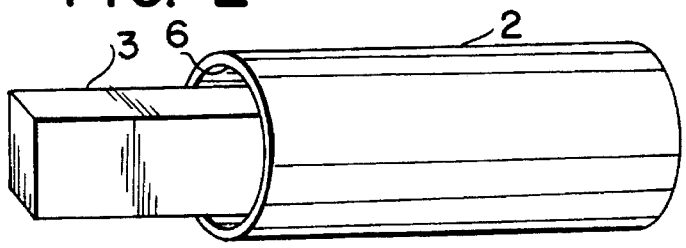
FIG. 2 is a perspective view of the elements of FIG. 1, partially assembled, with the cylindrical electrode member compressed into elliptical shape and the current distributor member partially inserted therein.
Figure 3:
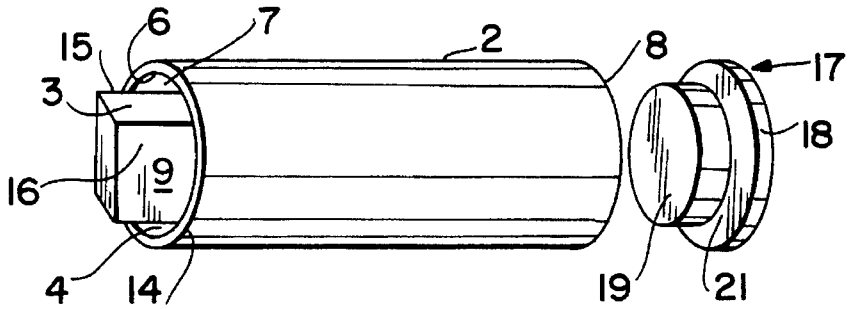
FIG. 3 is a perspective view of the elements of FIG. 1 in assembled form with an assembly end closure element in exploded view.

The FIGS. 1–3 depict key elements for a most typical electrode assembly of the present invention. However, they should not be construed as limiting the invention.

Referring then to FIG. 1, tubular shaped, hollow and elongate outer electrode member 2 has an elongate side wall 1 with open ends 7, 8. The electrode member 2 has a hollow core 4 between the open ends 7, 8. This typical hollow and elongate outer electrode member 2 has a circular cross-section. For insertion into the electrode member hollow core 4, there is an elongate and bar-shaped, inner electrical current distributor member 3. This current distributor member is rectangular in cross-section. The dimensions of the current distributor member are such that the diagonal of the member 3 is greater than the inside diameter of the electrode member hollow core 4. Therefore, the current distributor member 3 cannot be readily inserted into the hollow core 4. The electrode member 2 has an inner major face 6 of at least substantially rounded cross-section and an outer major face 5 shown in the same cross-section. For the electrode member 2 of the figure, the cross-section of each face 5, 6 is circular. Shown at the left hand side of the electrode member 2 in the figure is one open end 7; then, at the right is the other open end 8, which is an opposite end 8. It is to be understood that the electrode member 2, in use, may be utilized in a variety of orientations. However, for convenience, the electrode member end 7 may sometimes be referred to herein as the top end 7. Conversely, for convenience, the electrode member end 8 may be referred to herein as the bottom end 8.

The current distributor member 3 has an outer major face 9 comprised of all the longitudinal surfaces. This current distributor member 3 has a current distributor member end face 11*a* at end 11, shown at the left hand side in the figure, as well as an opposite current distributor end face at end 12. As for the electrode member 2, the current distributor end 11 may sometimes be referred to herein for convenience as the top end 11 and, conversely, the current distributor end 12 may conveniently be referred to herein as the bottom end 12. The end face 11*a* and the face of the opposite end 12 provide only a minor proportion, compared to the outer major face 9, of the outer area of the current distributor member 3.

Referring then to FIG. 2, the electrode member 2 of circular cross-section is pressed, by means not shown, into an elliptical shape. As shown in the figure, the electrode member 2 in this shape has a current distributor member 3 partially inserted in the electrode member 2. Because of the oval shape of electrode member 2, the current distributor member 3 readily fits within the hollow core 4 of electrode member 2 without engaging the electrode member inner major face 6.

Referring then to FIG. 3, the insertion of the current distributor member 3 has been completed within the electrode member hollow core 4. The electrode member 2 has been permitted to relax back toward its generally circular shape. In this form, these assembled members 2, 3 may sometimes be referred to herein as an electrode assembly. In this relaxation, the edges 15 on the current distributor outer major face 9 bite into the electrode member inner major face 6, providing electrical junctions 14. Preferably, for economy of assembly, the electrode member 2 as a tube is a seamless tube whereby typically care need not be taken for the location of the electrical junctions 14. However, if the electrode member 2 contains a weld seam (not shown), preferably the electrical junction 14 will be displaced from the weld seam to avoid undue stress on the seam which may lead to premature assembly failure.

As seen in FIG. 3, a portion of the current distributor member 3, usually termed herein an extension section 16, juts out beyond the electrode member top end 7. This extension section 16 can be utilized for connecting with a source of electrical current as through a hanger (all not shown). At the electrode member bottom end 8, i.e., the opposite end from the extension section 16, there is a plug 17 for sealing the electrode member end 8. The plug 17 has an end cover 18 and extended central portion 19 having the same inside diameter as the electrode member 2. The end cover provides a flange 21 which butts against the edge of the electrode member bottom end 8. The plug 17 thereby seals the bottom end 8 of the electrode member 2. With the sealing of the electrode member bottom end 8 by the plug 17, and by attachment of any means such as a hanger (not shown) to the extension section 16, there is formed a representative electrode assembly in sealed form including electrode member 2, removable current distributor member 3 and hanger (not shown).

Figure 4:
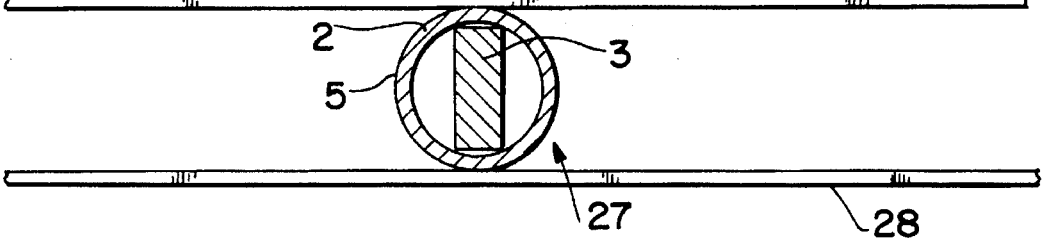
FIG. 4 is a plan view of an electrode assembly with the elements if FIG. 1 serving as a riser spaced between electrode sheets.

Referring next to FIG. 4, the current distributor member 3 and electrode member 2 are utilized as a riser 27 in an electrode assembly. Such assemblies have been shown, for example, in U.S. Pat. Nos. 4,033,849, 4,129,292 and 4,154,667. The riser 27 is situated between a pair of electrode sheets 28. Although the electrode sheets 28 are depicted in the figure to be secured to the outer face 5 of the electrode member 2 of the riser 27, e.g., as by welding, it will be understood by those skilled in the art that the electrode sheets 28 may be spaced apart from such outer face 5 of the riser 27 and connected thereto as by spring members (not shown) to form an expandable assembly. Thus, the electrode sheets 28 can be in attachment with the electrode member 2 either by directly securing to such member 2 or by intermediate elements between the member 2 and the sheets 28. For the riser 27, the electrode member 2 can be a solid or a perforate member. As a perforate member, it can be an expanded metal mesh member. Typically, the electrode sheets 28 are expanded metal sheets. In the configuration of this figure, the electrode assembly can be serviceably utilized in electrolytic cells which find use as in the production of chlorine and caustic from electrolysis of brine.

Figure 5:
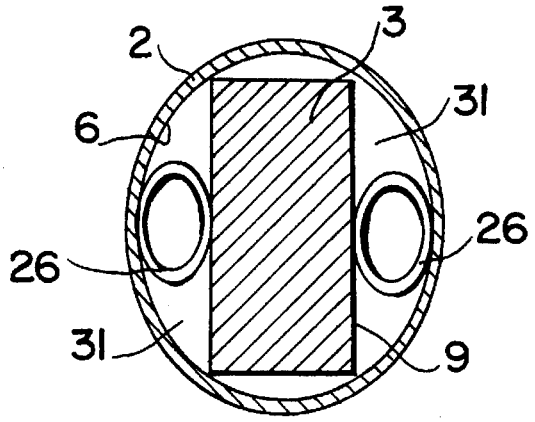
FIG. 5 is a front view of an electrode assembly wherein the current distributor member is augmented by coil springs.

Referring then to FIG. 5, the current distributor member 3 and electrode member 2 are configured so as to maintain a space 31 on parallel elongate sides of the current distributor outer major face 9. Spaced between these sides of the face 9, and the opposite electrode member inner major face 6, as spring members, are coil springs 26. These coil springs 26 are compressed along and between the faces 6, 9 thereby providing further electrical and mechanical contact between the faces 6, 9. Although the springs 26 shown in the figure are described and shown as coil springs, it will be understood by those skilled in the art that other spring members may be utilized between the faces 6, 9 of the assembly arrangement, as will be discussed further on hereinbelow. When coil springs are used, since they are positioned along the faces 6, 9, they may sometimes be referred to herein as the "elongate coil springs".

Figure 6:
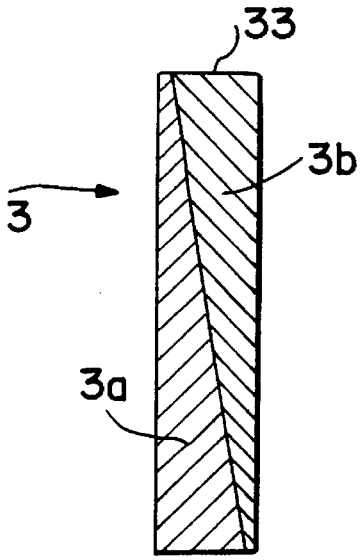
FIG. 6 is an elevational view of a tapered wedge current distributor member.

Referring next to FIG. 6, the current distributor member 3 is a bar made from two tapered wedge members 3*a*, 3*b* which, when wedged together, can provide an elongate and bar-shaped current distributor member 3. These wedge members 3*a*, 3*b* can be brought together within an electrode member (not shown) by exerting a force as at the top 33 of the wedge member 3*b*. The exertion of this force, sometimes referred to herein as an "installation force" or "assembly force" can be utilized to exert pressure at the connections between the current distributor member 3 and an electrode member. For some applications, such as for the riser 27 in FIG. 4, this installation force may be serviceable to provide a suitable assembly without providing any bending stress on the electrode member 2 in FIG. 4. However, it is to be understood that in the assembly of FIG. 4, as with the other assemblies depicted herein wherein a bar-shaped current distributor member 3 may be utilized, there can be combined a bending stress on an electrode member 2 with an installation force on a current distributor member 3 of tapered wedges 3*a*, 3*b* to obtain the mechanical and electrical contact between the current distributor member 3 and electrode member 2.

Figure 7:
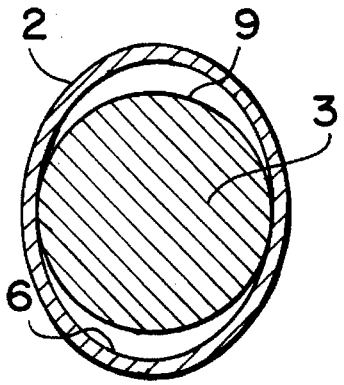
FIG. 7 is a front view of an electrode assembly having an oval electrode member and a rounded current distributor member that is circular in cross-section.
Figure 8:
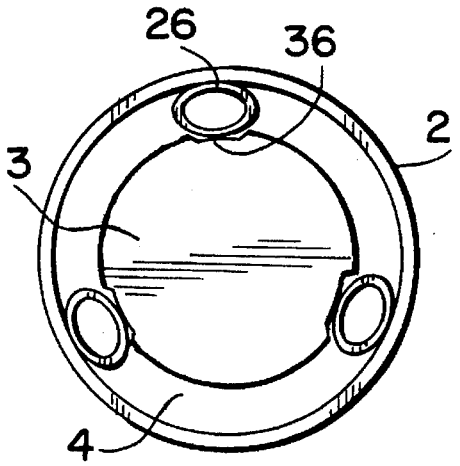
FIG. 8 is a front view of an electrode assembly with the current distributor member in cylindrical form, which member is maintained in place and in electrical contact by coil springs.

Referring next to FIG. 7, a circular current distributor member 3 is positioned within an oval electrode member 2. Thus, in this combination, the current distributor member 3 can have a completely rounded outer major face 9. Nevertheless, there will be provided an electrical and mechanical contact between the current distributor outer major face 9 and the electrode member inner major face 6. Such contact could be furthered by the use of springs, such as coil springs 26 (FIG. 5). Where springs are utilized, such may be employed for completely providing the contact between the current distributor member 3 and the electrode member 2 as is depicted in FIG. 8, which is discussed further on hereinbelow.

In preparing an electrode assembly, and referring again to FIG. 1, an electrode member 2 is pressed, as by a hydraulic press, into the elliptical shape of the electrode member 2 of FIG. 2. Then the current distributor member 3 is inserted into the hollow aperture 4 of the electrode member 2. This current distributor member 3 can have connection means (not shown) attached to the current distributor member 3 before or after insertion into the hollow aperture 4 of the electrode member 2. Following insertion, the pressure on the electrode member 2 is relaxed and this electrode member 2 springs back to its original circular shape as shown in FIG. 3. By springing back, the edges 15 on the outer major face 9 of the current distributor member 3 bite into the inner face 6 of the electrode member. Thereafter, a plug 17, as shown in FIG. 3, can be inserted to enclose an end 8 of the electrode member 2. This plug 8 is typically of the same metal, e.g., titanium, as for the electrode member 2. For a liquid tight seal, the plug 17 may be metallurgically bonded to the electrode member 2, as by welding. The electrical connection means (not shown) for the current distributor member 3 will usually be provided at an extension section 16 of the current distributor member 3. In this manner, a finished electrode assembly, of the type wherein one end is sealed and an opposite end has a current distributor extension section 16 for electrical connection, is made.

For preparing the electrode assembly of FIG. 5, the electrode member 2 can be pressed into an elliptical shape in the manner as discussed hereinabove. Then the current distributor member 3 can be inserted into the hollow aperture for the electrode member 2. At this time, or after relaxation of the pressure on the electrode member 2, the coil springs 26 can be stretched in an elongated form to reduce their diameter. In this form, these springs 26 are then inserted into the space 31 in the hollow core between the current distributor face 9 and electrode member face 6. The springs 26 are then relaxed from their stretched position and permitted to enlarge in diameter for pressing between the current distributor face 9 and electrode member face 6.

In preparing an electrode assembly wherein there is used the FIG. 6 tapered wedge current distributor member 3, one tapered wedge 3*a* can be initially inserted into an electrode member 2. The electrode member 2 may or may not be pressed, such as into elliptical shape. Thereafter, the second tapered wedge 3*b* is forced against the previously installed tapered wedge 3*a*, the installation being in a manner so as to juxtapose the tapered faces of each wedge 3*a*, 3*b* in the manner as shown in the figure. This installation force, exerted for example at the top 33 of the tapered wedge 3*b* will provide for a force reaction exerted from the current distributor outer major face 9, as at edges 15 (FIG. 3), against the inner major face 6 of an electrode member 2. As noted hereinabove, this installation force from the wedge structure may be used without benefit of external pressure exerted on the electrode member 2. The electrode assembly may thus be put together in this manner, with the proviso that the electrode member can be subsequently compressed by externally applied pressure and the wedge current distributor member 3 readily removed, without exceeding the yield point of the electrode member 2 during such disassembly. This is of particular importance during electrode assembly refurbishing, as well be more particularly discussed hereinbelow.

Where this tapered wedge force has been combined with an externally applied pressing of the electrode member 2, such as into an elliptical shape, this pressing can then be relaxed on the electrode member 2, permitting it to spring back toward its original shape. In this combination, an augmented forceful electrical and mechanical contact can be exerted during assembly between the current distributor member 3 and electrode member 2, combining the installation force of the tapered wedge current distributor member 3 with the springing back of the electrode member 2. For preparing an electrode assembly as shown in FIG. 7, the same procedures can be employed as referred to hereinabove in connection with FIG. 1. Thus, in brief, a pressure is exerted on the electrode member 2. Then the current distributor member 3 is inserted into the hollow aperture 4 of the electrode member 2 and pressure on the electrode member is relaxed. This permits the electrode member 2 to spring back toward its original shape and provide contact between the electrode member 2 and current distributor member 3.

Although the preparation of an electrode assembly has been shown in the sequence of the foregoing described FIGS. 1–3 by taking the electrode member 2 from circular shape, to oval, back to circular shape, it is contemplated that the variation of going from initial oval shape, to circular shape, and back to oval, could be utilized. Where the sequence is initiated with a circular electrode member 2 and referring again to the hereinbefore described representative titanium member of 1.75 inch outside diameter and 0.049 inch wall thickness, such titanium tube can be laid horizontally in a hydraulic press. In the press, the tube can be deflected into an elliptical shape of approximately two inches by one and one-half inches. It is necessary that the deflection is held below the yield point of the titanium. While in this oval shape, the representative copper 1.67 inch width by 0.05 inch thick bar can be easily slid into the titanium tube. By releasing the pressure on the tube, the four edges of the copper bar bite into the inner face of the titanium tube and make electrical contact with the tube. The copper bar and the titanium tube can be dimensioned whereby the tube springs back toward its original circular shape but advantageously not completely back, as has been discussed hereinabove. Thus, the proportional dimensions of the electrode member 2 to the current distributor member 3 are advantageously such that the tube retains somewhat of an oval shape after compressive pressure is released.

Moreover, the current distributor member 3 could be shaped so that a portion of its outer face 9 is rounded, i.e., forming a rounded side. In such instance, the rounded side could be in contact with the inner face 6 of the electrode member 2. It is thus contemplated that the electrode member inner face 6 may be in flexed engagement with not only edges, but also some sides, although not all sides, of the current distributor member 3. Thereby, there will always be a gap, and virtually always many gaps, e.g., four gaps for the assembly of FIGS. 1–3, between the inner face 6 of the electrode member 2 and the outer face 9 of the current distributor member 3. Furthermore, the current distributor member 3 may be shaped so that not all edges engage the inner face 6 of the electrode member 2. Thus, a current distributor member 3 that is a trapezium in cross-section and is maintained within a circular electrode member 2 may have three of four edges engaging the inner face 6. Preferably, however, for efficient electrical contact, all edges will engage the inner face 6.

As is shown in FIG. 1, the electrode member 2 and current distributor member 3 are structured so as to provide a continuous electrical junction 14 along each edge 15 of the current distributor member coming into contact with the electrode member 2. Typically, this is a continuous electrical junction 14 along the total length of the electrode member 2. For assuring this, the bottom end 8 of the electrode member 2 may be sealed by other than a plug 17, for example, by a sealing member resembling a bottle cap. By any such means, the resulting electrode assembly is a sealed assembly.

However, the finished electrode assembly need not be a sealed assembly, depending on its application. Thus, for example, the assembly may be maintained in an unsealed condition, as at the top end 7, such as for use in a cell which has a cover through which the assembly can be inserted, with the unsealed end retained above the cover. Moreover, although it is advantageous that the electrical junction 14 along the edges 15 of the current distributor member be continuous, other structure is contemplated. Also, the current distributor member 3 need not extend from end to end of the electrode member 2. Particularly where a plug 17 is used to cap one end of the electrode member 2, the current distributor member 3 need not extend completely to the end 8. It can fall short of extending to the end 8 by extending within the hollow core 4 up to the extended central portion 19 of the plug 17. The current distributor member 3 may or may not be in contact with the extended central portion 19 of the plug 17. Where the operative surface of the electrode member 2 will be the outer major face 5, the current distributor member 3 will usually not extend to the extended central portion 19 of the plug 17.

It is contemplated that the electrode member 2 will generally be a non-perforate metal member. However, particularly where it is an unsealed member 2, it may be perforate. Although the electrode member 2 of at least substantially rounded cross-section has been discussed herein generally as being circular or oval in cross-section, other cross sections, typically a many-sided polygon, e.g., of greater than seven sides, such as an octagonal shaped electrode member 2, can be useful. Such cross-section typically refers to the shape of the electrode member 2 at both its inner major face 6 and outer major face 5. However, these can be different. When they are different, advantageously for efficiency of deflection combined with efficient spring reaction on pressure release, an electrode member 2 will have, at its inner major face 6, a generally circular or oval cross-section. Then, at the outer major face 5, the electrode member 2 can be of differing rounded shape, e.g., a polygon.

Prior to inserting the current distributor member 3 into the electrode member 2, it may be desirable to coat either the outer major face 9 of the current distributor member 3 or the electrode member 2 inner face 6, or both. Such a coating can be a metallic coating to enhance electrical connection at the electrical junctions 14. As an example, the inner face 6 of the electrode member 2 may have a coating thereon of a metal such as of copper, nickel, silver or their alloys and intermetallic mixtures. The coating to such inner face 6 could be applied as by electroplating, including brush plating, electroless plating, or thermal spray technique, e.g., copper electroplating of a titanium electrode member 2. The current distributor member 3 could have a metal coating applied thereto as by electroplating, thermal spray technique or brush plating. The current distributor member 3 might also be a clad member or the like, e.g., in the form of a titanium clad copper bar. Thus, "coating" as the term is used herein for the electrode member 2 or the current distributor member 3 is meant to include plating or cladding or other covering. Where the current distributor member 3 is a titanium clad copper bar or the like, such may be advantageously useful with a perforate, e.g., expanded metal mesh, electrode member 2, where the environment of use of the assembly could result in copper corrosion.

Where the extension section 16 of the current distributor member 3 is provided with electrical connection means, such can be a hanger. It is contemplated that a hanger such as of copper, Monel (trademark) or titanium can be affixed, as by bolting, to the extension section 16. Where the assembly will be used in a cell operation, such as electroplating or electrowinning, the hanger can be V-shaped whereby the top of the hanger can fit over a rail, usually a copper rail, which will serve as a current supply element. With or without electrical connection, the assembly may be sealed at the current distributor extension section 16. Sealing can be by any means useful for providing a liquid tight cap to the assembly at the top end 7 of the electrode member 2. For this purpose, heat shrink tubing can be useful, e.g., heat shrunk polyvinylchloride (PVC) or polyolefin tubing. A silicone adhesive/sealant or caulk typically a polysiloxane, room temperature curable liquid or paste, may also be utilized. Furthermore, plastisols can be employed. Usually, where the current distributor member 3, or, for example, where coating such as on the inner major face 6 of the electrode member, would be deleteriously affected by the operating environment of the electrode assembly, the electrode member ends 7, 8 are sealed. For example, where corrosion of a copper current distributor member 3 may result from electrolyte in a chromium electroplating process, there is used both a seal such as a plug 17 at the bottom end 8 of the electrode member 2, as well as a seal such as heat shrunk PVC tubing, usually with caulking, at the top end 7 of the electrode member 2. Other processes for which a finished electrode assembly may be used include electroplating of tin, zinc, chromium or nickel, as well as electrowinning of copper or cobalt. Furthermore, the assembly may be utilized in a diaphragm cell or membrane cell for production of chlorine, caustic, hypochlorite, HCl, sodium sulfate and similar chemicals.

As will be understood, the electrode assembly is particularly serviceable when the need arises for refurbishing the electrode. As used herein, "refurbishing" is meant to also include repair or the like. For this refurbishing, the assembly procedure can be reversed. Initially, where any seal is present at the top end 7, it is removed. Also, any end plugs 17 may be, or may not need to be, removed. The electrode member 2 can then be compressed and the current distributor member 3 removed. After removal of the current distributor member 3, it can be refurbished by means understood by those skilled in the art. For example, a damaged electrode member could be replaced or a copper current distributor member subjected to inadvertent corrosion by exposure to electrolyte, may be simply replaced. Also, such current distributor member might be refurbished as by removal of old surface metal, e.g., by machining of the current distributor member outer surface. With or without old metal removal, a new surface can be applied to the current distributor member, such as by thermal spray technique. Also, where the current distributor member has a coating, the old coating may be removed and a fresh coating applied.

Where the electrode member will be retained, any coatings on the inner face 6 as well as the outer face 5 of the electrode member 2 can then be refurbished, for example, by initial removal. This removal can utilize any rigorous treatment that will not deleteriously affect the integrity of the electrode member 2, which treatment can be conducted without concern for abusing the current distributor member 3. As representative of this treatment, where an electrochemically active coating of at least one oxide of a platinum group metal is present on the outer face 5 of the electrode member, such may be removed by any typical procedure known in the art for this operation. These procedures can include rigorous mechanical means, such as grit blasting, or chemical means including immersion of the electrode member 2 in an elevated temperature bath of metal salts. Any metal coating on the inner face 6 of the electrode member, for example a silver coating, which is in need of refurbishing, could be removed if required, as by chemical cleaning, or by mechanical cleaning such as wire brushing. Thereafter, a freshly applied coating on the inner face 6, e.g., a silver electroplate coating, may be applied. Then on the outer face 5, a fresh electrochemically active coating can be applied. Thereafter, the original procedure for assembling the electrode assembly is repeated including pressing of the electrode member 2 to provide a shape change, insertion of the current distributor member 3, and relaxing of the pressure on the electrode member 2.

It is also contemplated that there can be assembled an electrode member 2 and current distributor member 3, where the current distributor member 3 is generally in at least substantially rounded cross-section, and the members 2, 3 may be maintained in place by resilient, electrical connection members which are spring members.

Referring in this regard to FIG. 8, the electrode member 2 and current distributor member 3 have, as spring members, the coil springs 26 maintained between the electrode member 2 and current distributor member 3. In this configuration, the current distributor member 3 may be cylindrical and positioned coaxially to the electrode member 2 in the hollow core 4 of the member 2. The coil springs 26 can be maintained in alignment by positioning in a keyway 36 within the current distributor member 3. As shown in FIG. 8, the coil springs 26 can be elongate coil springs 26 that are straight linear coils parallel to the axis of the current distributor member 3. Alternatively, the coil springs could be in other configuration, e.g., flat wave form. The flat wave form springs can be elongate, flat springs in wave form positioned along the keyway 36. It is advantageous that the springs 26 have an outside diameter larger than the inside diameter of the electrode member 2 and an inside diameter smaller than the outside diameter of the current distributor member 3. These parameters can provide for spring deflection resulting in a substantially uniform radial contact force for desirable electrical contact.

This electrode assembly can be assembled by first stretching, i.e., elongating, the springs 26 to reduce their diameter. The electrode member 2, which may be under bending stress, can be slipped over the extended springs 26, which are around the current distributor member 3. When the springs 26 are released from stretched position, their diameter enlarges and forcefully contacts both the electrode member 2 and the inner major face 6 of the electrode member 2. Disassembly of this electrode assembly can be handled in reverse manner, e.g., the springs 26 are first extended to reduce their diameter whereby the electrode member 2 can be slipped away from the springs 26 and the current distributor member 3.

The coil springs 26 by spring action maintain the spatial configuration for the electrode member 2 and current distributor member 3 between themselves. Additionally, these coil springs 26 will provide electrical contact between the members 2, 3. Because of the providing of this electrical connection, it is advantageous that these coil springs 26, or the other spring members mentioned herein, be of a metal such as berylium copper. However, other metals for the spring members, such as phosphor bronze, are also contemplated. The spring members may also be coated, including coatings as mentioned hereinabove.

As a variation where the electrode member 2 and current distributor member 3 are maintained in place by a spring member, there can be used bracelet coils, also termed herein bracelet coil springs. Thus, referring to FIG. 9, an electrode member 2 and current distributor member 3 are maintained in place by a bracelet coil spring 35. This bracelet coil spring 35 is looped within the space of the hollow core 4 provided between the electrode member inner face 6 and current distributor member outer face 9. Alternately, the bracelet coil spring 35 could be in other configuration, e.g., a radial bracket spring. Such a radial bracket spring can be a flat spring in wave form which is formed into a circular coil, i.e., in the manner that an elongate coil spring can be bent around to provide a bracelet coil spring.

Figure 10:
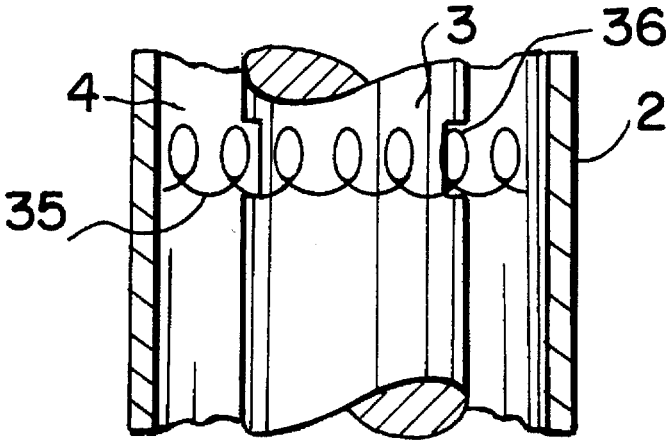
FIG. 10 is an elevational view of a portion of the electrode assembly of FIG. 7.

Then, in referring to FIG. 10, it can be seen that the bracelet coil spring 35 can be spaced within a keyway 36 of the current distributor member 3. In this manner, the coil spring 35 is spaced and maintained axially within the hollow core 4. The coil spring 35 exerts a radial load between the electrode member 2 and current distributor member 3 for maintaining good mechanical and electrical contact therebetween. Moreover, the keyway 36 helps in maintaining the alignment between the members 2, 3 and for maintaining the established radial load.

Figure 9:
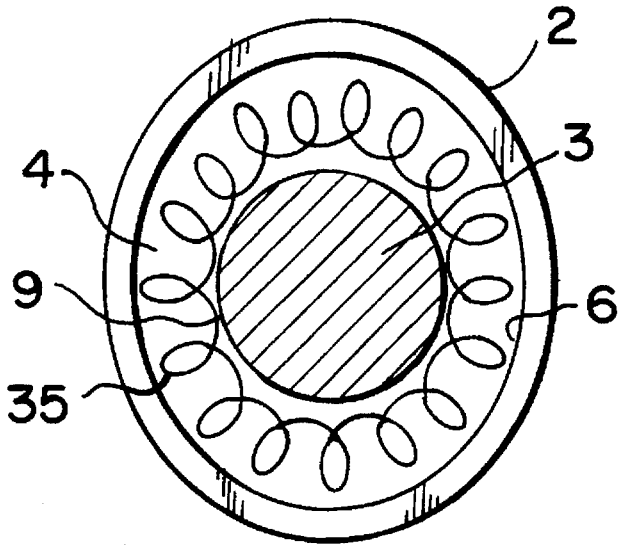
FIG. 9 is a front view of an electrode assembly having a cylindrical current distributor member, which member is maintained in place by bracelet coils.

To assemble this FIGS. 9 and 10 electrode assembly, the coil springs 35 are snapped over the current distributor member 3 and into the keyway 36. The electrode member 2 can then be slid over the coil spring 35. In this manner of assembly, the electrode member 2 progressively compresses each coil spring 35 one-by-one along the length of the current distributor member 3.

As a further variation of the arrangement of FIGS. 8 and 9, but employing a current distributor member 3 of at least substantially rounded cross-section, e.g., a cylindrical member 3, there can be used spring members other than the coil springs 26 and bracelet coil springs 35. One such spring member would be a flat wave form spring. A particularly useful spring member is one which is stamped out with multiple fingers or louvers protruding in both radial directions, and sometimes referred to herein as a "multiple louver spring". These fingers can effect a high load, sharp edge electrical contact at many locations between the electrode member 2 and current distributor member 3. A well-known spring of this type is the Multi-Lam (trademark) spring.

As representative of the electrochemically active coatings that have been mentioned hereinbefore and that may be applied to an electrode member outer major face 5 are those provided from platinum or other platinum group metals or they can be represented by active oxide coatings such as platinum group metals, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings include tin oxide, manganese dioxide, lead dioxide, cobalt oxide, ferric oxide, platinate coatings such as $M_xPT_3O_4$ where M is an alkali metal and x is typically targeted at approximately 0.5, nickel-nickel oxide and nickel plus lanthanide oxides.

We claim:

1. An electrode assembly comprising a hollow and substantially thin walled, elongate and deflectable, outer metal electrode member having inner and outer major faces and an at least substantially rounded cross-section, said assembly having a removable and elongate, inner metal electrical current distributor member which has an outer major face, with a perimeter of said electrode member inner face being in flexed engagement with less than all of the perimeter of said current distributor member outer face by autogenous compressive force of said electrode member, and with said engagement providing electrical junction between said current distributor member and said electrode member.

2. The assembly of claim 1 wherein said electrode member is a non-perforate valve metal tube.

3. The assembly of claim 2 wherein said valve metal is selected from the group consisting of titanium, tantalum, niobium, zirconium, their alloys and intermetallic mixtures.

4. The assembly of claim 1 wherein said at least substantially rounded electrode member in cross section is a circle, oval or many-sided polygon, with said current distributor member outer major face having sides and edges, and said electrode member inner face is in flexed engagement with current distributor member outer face edges.

5. The assembly of claim 1 wherein said electrode member has at least one sealed end.

6. The assembly of claim 1 wherein said electrode member has unsealed ends and is deflectable by externally applied compression exerted on its outer face.

7. The assembly of claim 1 wherein said electrode member inner face has a coating of a metal selected from the group consisting of copper, nickel, silver, their alloys and intermetallic mixtures.

8. The assembly of claim 1 wherein said electrode member is an at least substantially straight titanium tube having an outside diameter of from about 0.5 inch to about 3 inches, a wall thickness of from about 0.02 inch to about 0.12 inch, and a length of from about 12 inches to about 100 inches.

9. The assembly of claim 1 wherein said at least substantially thin walled electrode member has an outside diameter proportioned to the electrode member wall thickness within the range from about 25:1–45:1.

10. The assembly of claim 1 further including at least one electrode sheet in attachment with said outer major face of said electrode member. hypochlorite, HCl or sodium sulfate.

11. The assembly of claim 1 wherein said electrode member has an electrochemically active coating on said outer major face.

12. The assembly of claim 11 wherein said electrochemically active coating contains a platinum group metal, or metal oxide or their mixtures.

13. The assembly of claim 11 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide and nickel plus lanthanide oxides.

14. The assembly of claim 1 wherein said current distributor member is in solid, unitary form and is a metal of copper, or alloy or intermetallic mixture of copper.

15. The assembly of claim 1 wherein said current distributor member is a two-piece member of tapered wedges.

16. The assembly of claim 1 wherein said current distributor member in cross-section is a square, rectangle, fully rounded shape, trefoil, quatrefoil, trapezoid or polygon shape of few sides.

17. The assembly of claim 1 wherein said electrode member is oval in cross-section and said current distributor member is circular in cross-section.

18. The assembly of claim 1 wherein said current distributor member does not extend beyond at least one end of said outer metal electrode member, said electrode member is sealed at said end, and said current distributor member is in contact with the end seal.

19. The assembly of claim 1 wherein said current distributor member extends beyond one end of said electrode member and the extension connects said electrode assembly with a source of electrical current.

20. The assembly of claim 19 wherein said end extension is connected with an assembly hanger member.

21. The assembly of claim 1 wherein said current distributor member in cross-section has sides and edges, said current distributor member maintains edge engagement with said electrode member, and said autogenous compressive force provides a flexed compression joint between said current distributor member and said electrode member.

22. The assembly of claim 1 wherein said flexed engagement extends at least substantially along the total length of said electrode member and is at least substantially continuous along said length.

23. The assembly of claim 1 further including at least one spring member in flexed engagement with both said electrode member inner face and said current distributor member outer face.

24. The assembly of claim 23 wherein said spring member is maintained within a keyway in at least one of said faces.

25. The assembly of claim 1 wherein said current distributor member in cross-section is a four-sided figure having a width within the range from about 0.5 inch to about 4 inches, a thickness within the range from about 0.125 inch to about one inch, and a length within the range from about 10 inches to about 100 inches.

26. The assembly of claim 1 wherein said current distributor member is longer than said electrode member by an amount within the range from about 2 inches to about 8 inches.

27. The assembly of claim 1 wherein said current distributor member has a hanger member affixed to one end of said current distributor member.

28. The assembly of claim 1 wherein said current distributor member is inserted within said electrode member prior to said flexed engagement of said electrode member against said current distributor member.

29. The assembly of claim 1 wherein said current distributor member has a diameter from one edge engagement to an opposite edge engagement of at least about 0.02 inch greater than the inside diameter of said electrode member at said opposite engagements.

30. The assembly of claim 1 wherein said current distributor member outer major face is coated and such coating includes cladding.

31. The assembly of claim 1 wherein said electrode member is a cathode and the metal of said cathode is nickel or steel.

32. The method of making an electrode assembly having a hollow and substantially thin walled, elongate and deflectable, outer metal electrode member having inner and outer major faces and an at least substantially rounded cross-section, said assembly having a removable and elongate, inner metal electrical current distributor member which has an outer major face, which method comprises:

(a) compressively flexing said hollow and deflectable electrode member of substantially rounded cross-section into deflected shape, said deflection being maintained below a yield point of the metal of said electrode member;

(b) inserting said current distributor member within the deflected shape of said hollow electrode member; and (c) releasing the flexed compression on said electrode member, establishing flexed engagement between less than all of the perimeter of said current distributor member outer face and a perimeter of the inner face of said electrode member by autogenous compressive force of said electrode member, with said flexed engagement providing electrical junction between said current distributor member and said electrode member.

33. The method of claim 32 wherein said electrode member is compressively flexed by externally exerted hydraulic or mechanical pressure, and said member is a valve metal member of a metal selected from the group consisting of titanium, tantalum, niobium, zirconium, their alloys and intermetallic mixtures.

34. The method of claim 32 wherein said electrode member is compressively flexed by an external hydraulic or mechanical pressure providing a bending stress maintained below about 25,000 psi and said member is a titanium member.

35. The method of claim 32 wherein said at least substantially rounded cross-section of said electrode member is a circular cross-section that is compressively flexed into an elliptical cross-section.

36. The method of claim 32 wherein said at least substantially rounded cross-section of said electrode member is an elliptical cross-section that is compressively flexed into a circular shape.

37. The method of claim 32 wherein said inserting of said current distributor member includes wedging together at least two current distributor tapered flexed wedge members and said wedging supplies an engagement force for said established flexed engagement.

38. The method of claim 32 wherein said current distributor member in cross-section is a four-sided figure providing four edges, each of said edges engages the inner face of said electrode member, and said current distributor member is a solid member of copper, or alloy or intermetallic mixture of copper.

39. The method of claim 32 further including coating the inner face of said electrode member prior to said step (a) compressive flexing.

40. The method of claim 39 wherein said coating includes applying a metal selected from the group consisting of copper, nickel, silver, their alloys and intermetallic mixtures.

41. The method of claim 32 further including coating the outer face of said current distributor member prior to said step (a) compressive flexing.

42. The method of claim 32 wherein said electrode member is coated with an electrochemically active coating on said outer major face.

43. The method of claim 42 wherein said electrochemically active coating contains a platinum group metal, or metal oxide or their mixtures.

44. The method of claim 42 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide and nickel plus lanthanide oxides.

45. The method of claim 32 further including sealing at least one end of said electrode member after the releasing in step (c) of said flexed compression.

46. The method of claim 32 further including engaging a hanger member for said electrode assembly with said current distributor member after the releasing said step (c) of said flexed compression.

47. The method of claim 46 wherein said electrode member is sealed after engagement with said hanger member.

48. An electrode assembly made by the method of claim 32.

49. The method of refurbishing an electrode assembly having a hollow and substantially thin walled, elongate and deflectable, outer metal electrode member having an inner major face, a coated outer major face and an at least substantially rounded cross-section, said assembly having a removable and elongate, inner metal electrical current distributor member which has an outer major face, with less than all of a perimeter of said outer major face being in contact with a perimeter of said electrode member inner face, which method comprises:

(a) compressively flexing said hollow and deflectable electrode member of substantially rounded cross-section into deflected shape, freeing the engagement of said current distributor member with said electrode member, said deflection being maintained below the yield point of the metal of said electrode member;

(b) removing said current distributor member from said hollow electrode member in deflected shape;

(c) releasing the flexed compression on said electrode member;

(d) refurbishing said electrode member;

(e) compressively flexing said refurbished electrode member into deflected shape, but below the yield point of the metal of said electrode member;

(f) inserting said current distributor member within the deflected shape of said hollow electrode member; and (g) releasing the flexed compression on said electrode member, establishing flexed engagement between less than all of the perimeter of said current distributor member outer major face and the perimeter of the inner face of said electrode member, with said flexed engagement providing electrical junction between said current distributor member and said electrode member.

50. The method of claim 49 wherein said electrode member is compressively flexed by externally exerted hydraulic or mechanical pressure, and said member is a valve metal member of a metal selected from the group consisting of titanium, tantalum, niobium, zirconium, their alloys and intermetallic mixtures.

51. The method of claim 50 wherein said electrode member is compressively flexed by an external hydraulic or mechanical pressure providing a bending stress maintained below about 25,000 psi and said member is a titanium member.

52. The method of claim 49 further including unsealing of at least one end of such assembly where said assembly includes end seals and before compressively flexing said electrode member in step (a).

53. The method of claim 49 further including refurbishing of said current distributor member.

54. The method of claim 49 wherein said refurbishing in step (d) comprises removing the coating from the outer face of said electrode member, preparing said outer face for fresh coating application, and coating said outer face of said electrode member with fresh coating.

55. The method of claim 54 wherein said electrode member outer face is coated with a fresh electrochemically active coating.

56. The method of claim 55 wherein said electrochemically active coating contains a platinum group metal, or metal oxide or their mixtures.

57. The method of claim 55 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide and nickel plus lanthanide oxides.

58. The method of claim 49 further including:

(h) connecting a hanger member to said current distributor member at an end of said current distributor member; and (i) sealing said electrode member at said end.

59. The method of claim 49 further including removing spring members from said electrode assembly prior to said step (d) refurbishing of said electrode member and inserting spring members in said electrode member after said step (d) refurbishing.

60. A refurbished electrode assembly made by the method of claim 49.

61. An electrode assembly comprising:

(1) a hollow and substantially thin walled, elongate and deflectable, outer metal electrode member having inner and outer major faces and an at least substantially rounded cross section;

(2) a removable and elongate, inner metal electrical current distributor member which has an outer major face; and (3) a metal spring member positioned between, and in flexed engagement with, both of said electrode member inner face and said current distributor member outer face, whereby said flexed engagement provides electrical junction and maintains positioning between said current distributor member and said electrode member.

62. The assembly of claim 61 wherein said current distributor member outer major face has sides and edges and at least some, but not all, of said outer major face is in contact with said electrode member inner face.

63. The assembly of claim 62 wherein said outer major face edges engage said electrode member inner face and said spring member is positioned between sides of said electrode member outer face and said electrode member inner face.

64. The assembly of claim 61 wherein said electrode member is a non-perforate valve metal tube, and said valve metal is selected from the group consisting of titanium, tantalum, niobium, zirconium, their alloys and intermetallic mixtures.

65. The assembly of claim 61 wherein said at least substantially rounded member in cross-section is a circle, oval or many-sided polygon.

66. The assembly of claim 61 wherein said electrode member inner face has a coating of a metal selected from the group consisting of copper, nickel, silver, their alloys and intermetallic mixtures.

67. The assembly of claim 61 wherein said electrode member is a titanium tube having an outside diameter of from about 0.5 inch to about 3 inches, a wall thickness of from about 0.02 inch to about 0.12 inch, and a length of from about 12 inches to about 100 inches.

68. The assembly of claim 61 further including at least one electrode sheet in attachment with said outer major face of said electrode member.

69. The assembly of claim 61 wherein said electrode member has an electrochemically active coating on said outer major face and said electrochemically active coating contains a platinum group metal, or metal oxide or their mixtures.

70. The assembly of claim 69 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide and nickel plus lanthanide oxides.

71. The assembly of claim 61 wherein said current distributor member is in solid form, is a metal of copper, or alloy or intermetallic mixture of copper, and in cross-section is at least substantially rounded.

72. The assembly of claim 61 wherein said current distributor member does not extend beyond at least one end of said outer metal electrode member, said electrode member is sealed at said end, and said current distributor member is in contact with the end seal.

73. The assembly of claim 61 wherein said current distributor member extends beyond one end of said electrode member and the extension connects said electrode assembly with a source of electrical current.

74. The assembly of claim 61 wherein said current distributor member outer major face is coated and said coating includes cladding.

75. The assembly of claim 61 wherein said metal spring member is an elongate coil spring, flat wave form spring, bracelet coil spring, radial bracket spring or multiple louver spring, and is of a metal of berylium copper or phosphor bronze.

76. The assembly of claim 61 wherein said spring member flexed engagement extends at least substantially along the total length of said electrode member and is at least substantially continuous along said length.

77. The assembly of claim 61 wherein said spring member is maintained within a keyway in at least one of said electrode member inner face or said current distributor member outer face.

78. The method of making an electrode assembly having a hollow and substantially thin walled, elongate and deflectable, outer metal electrode member having inner and outer major faces and an at least substantially rounded cross-section, said assembly having a removable and elongate, inner metal electrical current distributor member which has an outer major face, which method comprises:

(a) providing said hollow and deflectable electrode member of substantially rounded cross-section;

(b) providing as said current distributor member at least two tapered wedge members;

(c) inserting said current distributor member tapered wedge members within said hollow electrode member by wedging together said members in a manner engaging the inner face of said electrode member and flexing said electrode member into flexed engagement; thereby (d) establishing flexed engagement between said current distributor member outer major face and the inner face of said electrode member, with said edge engagement providing electrical junction between said current distributor member and said electrode member.

* * * * *

UNITED STATES PATENT AND TRADEMARK OFFICE

CERTIFICATE OF CORRECTION

PATENT NO. : 5,584,975

DATED : December 17, 1996

INVENTOR(S) : G. R. Pohto et al

It is certified that error appears in the above-indentified patent and that said Letters Patent is hereby corrected as shown below:

Title page, correct Attorney's name to read as follows:

"David J. Skrabec"

Column 16, line 7, after "member." delete "hypochlorite, HCl or sodium sulfate."

Signed and Sealed this

Eighteenth Day of March, 1997

Bruce Lehman

*Attest:*

BRUCE LEHMAN

*Attesting Officer*

*Commissioner of Patents and Trademarks*